US005645794A

United States Patent [19]

Beguinot et al.

[11] Patent Number: 5,645,794

[45] Date of Patent: Jul. 8, 1997

[54] LOW ALLOY STEEL FOR THE MANUFACTURE OF MOLDS FOR PLASTICS AND FOR RUBBER

[75] Inventors: Jean Beguinot; Frédéric Chenou, both of Le Creusot; Gilbert Primon, Saint Vallier, all of France

[73] Assignee: Creusot Loire Inudstrie, Puteaux, France

[21] Appl. No.: 540,011

[22] Filed: Oct. 6, 1995

[30] Foreign Application Priority Data

Oct. 31, 1994 [FR] France ..... 94 13029

[51] Int. Cl.[6] ..... C22C 38/32; C22C 38/54

[52] U.S. Cl. ..... 420/106; 420/108; 420/110; 148/334; 148/335

[58] Field of Search ..... 148/335, 334; 420/106, 108–111

[56] References Cited

U.S. PATENT DOCUMENTS 3,418,110 12/1968 Goda .
4,957,702 9/1990 Fang et al. ..... 420/106

FOREIGN PATENT DOCUMENTS 5-171356 7/1993 Japan .
5-302117 11/1993 Japan .
1020913 2/1955 United Kingdom .
2186594 8/1987 United Kingdom .

*Primary Examiner*—Deborah Yee
*Attorney, Agent, or Firm*—Sixbey Friedman Leedom & Ferguson; Thomas W. Cole

[57] ABSTRACT

Low alloy steel for the manufacture of molds for plastics or for rubber, the chemical composition of which comprises, by weight, 0.24% to 0.35% of carbon, 1% to 2.5% of manganese, 0.3% to 2.5% of chromium, 0.1% to 0.8% of molybdenum plus tungsten divided by 2, up to 2.5% of nickel, 0% to 0.3% of vanadium, less than 0.5% of silicon, 0.002% to 0.005% of boron, 0.005% to 0.1% of aluminum, 0% to 0.1% of titanium and less than 0.02% of phosphorus. The chemical composition must furthermore satisfy the relationship:

$$U=409(\%\ C)+19.3[\%\ Cr+\%\ Mo+\%\ W/2+\%\ V]+29.4(\%\ Si)+10(\%\ Mn)+7.2(\%\ Ni)<200$$

and the relationship:

$$R=3.82(\%\ C)+9.79(\%\ Si)+3.34(\%\ Mn)+11.94(\%\ P)+2.39(\%\ Ni)+1.43(\%\ Cr)+1.43(\%\ Mo+\%\ W/2)<11.14$$

11 Claims, 1 Drawing Sheet

LOW ALLOY STEEL FOR THE MANUFACTURE OF MOLDS FOR PLASTICS AND FOR RUBBER

FIELD OF THE INVENTION

Figure 1:
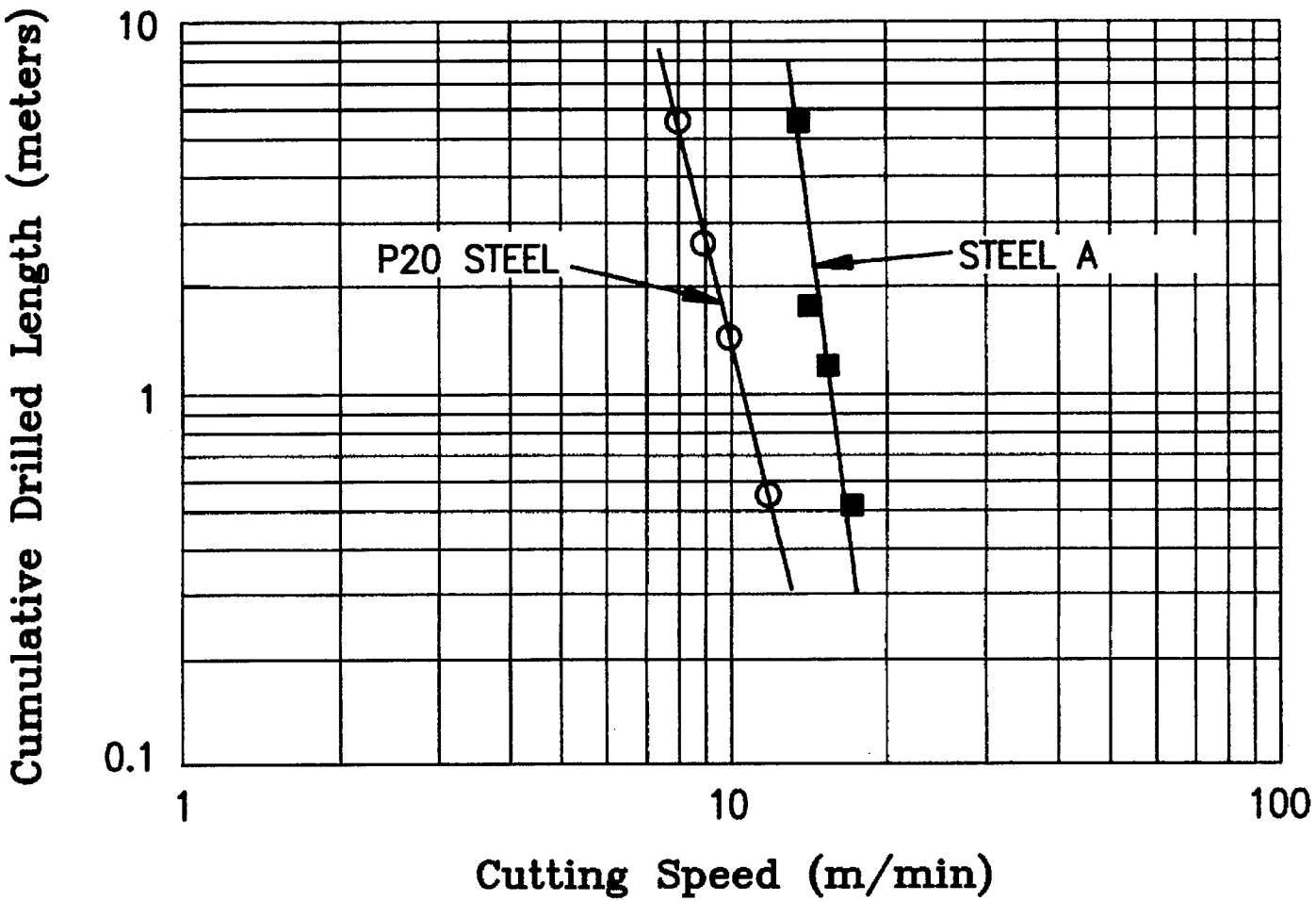

The present invention relates to a low alloy steel used in particular for the manufacture of molds for plastics or for rubber.

PRIOR ART

Molds for plastics or for rubber are manufactured by machining solid metal blocks, the thickness of which may exceed 500 mm. The surface of the mold cavity obtained by machining is usually either polished or chemically grained so as to give the desired surface appearance to the articles obtained by molding. In order to reduce mold wear as much as possible, any point on their surface must have a high hardness, between 250 HB and 400 HB and usually between 270 HB and 350 HB. They must also have the highest possible yield strength and a good impact strength in order to withstand impacts and deformations.

As the machining operation is very important, since it usually represents 70% of the total cost of manufacturing the mold, the metal must be as machinable as possible but, very often, the machinability cannot be achieved by too high a level of conventional additions, such as sulfur or lead, because such additions impair the ability of the metal to be polished or grained.

As molds are quite often repaired by welding, the metal used must also be as weldable as possible.

Finally, since plastics or rubber are molded hot, the metal used must have as high a thermal conductivity as possible so as to facilitate heat transfer which limits productivity in the manufacture of molded articles.

In order to manufacture the molds, it is common to use blocks of low alloy steel which is sufficiently hardenable to obtain, after quenching and tempering, a martensitic or martensito-bainitic structure having a sufficient hardness, a high yield strength and good toughness.

The steel most widely used is the steel P20, according to the AISI standard, or the steels W1.2311 or W1.2738 according to the WERKSTOFF German Standard.

P20 steel contains, by weight, 0.28% to 0.4% of carbon, 0.2% to 0.8% of silicon, 0.6% to 1% of manganese, 1.4% to 2% of chromium, 0.3% to 0.55% of molybdenum, the balance being iron and impurities associated with smelting.

W1.2311 and W1.2738 steels contain, by weight, 0.35% to 0.45% of carbon, 0.2% to 0.4% of silicon, 1.3% to 1.6% of manganese, 1.8% to 2.10% of chromium and 0.15% to 0.25% of molybdenum; W1.2738 steel furthermore contains 0.9% to 1.2% of nickel, the balance being iron and impurities associated with smelting.

These steels have a good wear resistance, but their weldability, machinability, toughness and thermal conductivity are insufficient.

In order to improve the weldability, a steel has been proposed, in Application EP 0,431,557, which contains, by weight, 0.1% to 0.3% of carbon, less than 0.25% of silicon, 0.5% to 3.5% of manganese, less than 2% of nickel, 1% to 3% of chromium, 0.03% to 2% of molybdenum, 0.01% to 1% of vanadium, less than 0.002% of boron, which element is regarded as being an undesirable impurity, the balance being substantially iron, and the composition furthermore having to satisfy the relationship:

$$BH=326+847.3(\%\ C)+18.3(\%\ Si)-8.6(\%\ Mn)-12.5(\%\ Cr)\leqq 460$$

From this relationship, the carbon content must remain less than 0.238%.

However, this steel, which certainly has good weldability and acceptable mathinability, does not have a sufficiently high thermal conductivity.

In fact, the person skilled in the art still chooses a composition lying within the indicated ranges so as to obtain sufficient hardenability to be able to produce parts whose thickness may exceed 400 mm; in particular, the various elements can never be simultaneously at the bottom of the ranges. Consequently, all these steels have a thermal conductivity less than 35 $W.m^{-1}K^{-1}$ and when, in some molds, it is necessary to have certain portions whose thermal conductivity is substantially higher, the corresponding portions are made of a copper/aluminum/iron alloy whose thermal conductivity is greater than 40 $W.m^{-1}K^{-1}$. However, this technique has the drawback of complicating the manufacture of the molds since they are then composite articles, and moreover the alloys used are much more expensive than steel.

SUMMARY OF THE INVENTION

The object of the invention is to provide a steel for the manufacture of molds for plastics or for rubber, which, while still having at least the same mechanical and mathinability properties as the known steels, has a thermal conductivity greater than 40 $W.m^{-1}K^{-1}$ so as, in particular, to enable all-steel molds to be manufactured.

For this purpose, the subject of the invention is a low alloy steel intended for the manufacture of molds for plastics or for rubber, the chemical composition of which comprises, by weight:

$0.24\% \leqq C \leqq 0.35\%$ $1\% \leqq Mn \leqq 2.5\%$ $0.3\% \leqq Cr \leqq 2.5\%$ $0.1\% \leqq Mo+W/2 \leqq 0.8\%$ $0\% \leqq Ni \leqq 2.5\%$ $0\% \leqq V \leqq 0.3\%$ $S \leqq 0.5\%$ $0.002\% \leqq B \leqq 0.005\%$ $0.005\% \leqq Al \leqq 0.1\%$ $0\% \leqq Ti \leqq 0.1\%$ $P \leqq 0.02\%$.

This composition furthermore satisfies the following relationships:

$$U=409(\%\ C)+19.3[\%\ Cr+\%\ Mo+\%\ W/2+\%\ V]+29.4(\%\ Si)+10(\%\ Mn)+7.2(\%\ Ni)<200$$

and $$R=3.82(\%\ C)+9.79(\%\ Si)+3.34(\%\ Mn)+11.94(\%\ P)+2.39(\%\ Ni)+1.43(\%\ Cr)+1.43(\%\ Mo+\%\ W/2)<11.14$$

Preferably, the steel contains:

$0.24\% \leqq C \leqq 0.28\%$ $1\% \leqq Mn \leqq 1.3\%$ $1\% \leqq Cr \leqq 1.5\%$ $0.3\% \leqq Mo+W/2 \leqq 0.4\%$ $0.03\% \leqq V \leqq 0.1\%$ The steel must preferably contain less than 0.1% of silicon.

In addition, copper may be added so as to obtain further hardening during tempering, the steel then having to contain 0.8% to 2% of nickel and 0.5% to 2.5% of copper.

The hardness may be improved by additions of niobium, in amounts of less than 0.1%, and the machinability may be improved by additions of sulfur, tellurium, selenium, bismuth, calcium, antimony, lead, indium, zirconium or rare earths in contents of less than 0.1%.

The subject of the invention is also the use of a steel according to the invention for the manufacture, by machining, of quenched and tempered steel blocks, the hardness of which lies between 270 HB and 350 HB.

The invention will now be described with regard to FIG. 1 which shows a diagram of the degree of drilling mathinability according to the Taylor method.

The steel according to the invention is a low alloy steel principally containing, by weight:

more than 0.24% C in order to obtain, after quenching and tempering above 500° C., a hardness greater than 270 HB, and less than 0.35% C in order not to degrade the weldability too much and to limit the extent of segregations unfavorable to machinability, polishability and grainability; preferably, the carbon content should lie between 0.24% and 0.28%;

more than 1% of manganese, in order to increase the hardenability of the steel, and less than 2.5% and preferably less than 1.3%, in order to prevent too great a decrease in thermal conductivity of the steel;

more than 0.3% of chromium, also to increase the hardenability and also to prevent formation of ferrito-pearlitic phases unfavorable to polishability, and less than 2.5% so as not to degrade the weldability and to prevent the formation of too large a quantity of chromium carbides, these being particularly unfavorable to machinability; preferably, the chromium content should lie between 1% and 1.5%;

more than 0.1% and preferably more than 0.3% of molybdenum, in order to increase the hardenability and to reduce the rate of temper softening, but less than 0.8% and preferably less than 0.4% since, in too high a quantity, molybdenum forms very hard carbides which are unfavorable to machinability, and shows a strong tendency to segregate into veining, which is unfavorable to polishability and grainability and may also induce tool fractures when machining. Molybdenum may be completely or partially replaced by tungsten, in a proportion of 2% of tungsten for 1% of molybdenum, so that the content to be taken into account is Mo+W/2;

between 0% and 0.3%, and preferably between 0.03% and 0.1%, of vanadium, so as to produce secondary hardening during tempering;

between 0.002% and 0.005% of boron accompanied by 0.005% to 0.1% of aluminum and 0% to 0.1% of titanium, so as to increase the hardenability significantly without impairing the other properties. Aluminum and titanium serve to prevent boron from combining with nitrogen which is almost always present in such a quantity that it is necessary to protect the boron.

In order for these additions to be effective, when the nitrogen content is greater than 50 ppm, the aluminum content must be greater than 0.05% when the titanium content is less than 0.005%; when the titanium content is greater than 0.015%, the aluminum content may be less than 0.03% and preferably lie between 0.020% and 0.030%;

less than 0.02% of phosphorus which is an embrittling impurity.

In addition to these main elements of the chemical composition, the steel contains, or may contain, elements such as silicon, copper and nickel, either by way of impurities or by way of supplementary alloy elements.

Steel, particularly when it is manufactured from scrap iron, contains a little copper and nickel. When the quantity of nickel is small, too high a copper content creates defects when hot rolling or hot forging, since it embrittles the grain boundaries. In the absence of specific additions, the nickel and copper contents each remain less than 0.5%.

Up to 2.5% of nickel may be added in order to increase the hardenability.

Copper may also be added in order to produce a structural hardening effect. In this case, the copper content must be between 0.5% and 2% and be accompanied by a nickel content of between 0.8% and 2.5%.

The hardness may also be adjusted by addition of niobium in amounts of less than 0.1%.

When the polishability or grainability requirements allow it, it is possible to improve the machinability by addition of sulfur, tellurium, selenium, bismuth, calcium, antimony, lead, indium, zirconium or rare earths in amounts of less than 0.1%.

The inventors have found that, in this chemical composition range, when:

$$U=409(\%\ C)+19.3[\%\ Cr+(\%\ Mo+\%\ W/2)+\%\ V]+29.4(\%\ Si)+10(\%\ Mn)+7.2(\%\ Ni)<200,$$

the machinability is very substantially better than for P20-type steels.

Finally, in order for the thermal conductivity to be high enough, it is necessary that:

$$R=3.82(\%\ C)+9.79(\%\ Si)+3.34(\%\ Mn)+11.94(\%\ P)+2.39(\%\ Ni)+1.43(\%\ Cr)+1.43(\%\ Mo+\%\ W/2)<11.14$$

Thus, the chemical composition must be chosen so that U<200 and R<25. The thermal conductivity is then greater than 40 $W.m^{-1}K^{-1}$.

In order to manufacture a mold, a steel according to the invention is smelted, possibly carrying out predeoxidation with silicon and then deoxidation with aluminum, followed by adding the titanium and boron.

The liquid metal thus obtained is cast in the form of a semi finished product, such as an ingot, a slab or a billet.

The semi finished product is then reheated to a temperature of preferably less than 1300° C. and is either forged or rolled in order to obtain a bar or sheet.

The bar or sheet is then quenched in order to obtain throughout its volume a martensitic or martensito-bainitic structure.

The quenching may be performed either directly, straight from rolling or forging, if the end-of-rolling or end-of-forging temperature is less than 1000° C., or after austenization at a temperature greater than the $Ac_3$ point and preferably less than 1000° C.

After the air, oil or water quench, depending on the dimensions, the bars or sheets are tempered at a temperature greater than 500° C. and preferably greater than 550° C. so as to obtain a hardness of between 270 HB and 350 HB, and preferably close to 300 HB, at all points in the bars or sheets, so that the internal stresses generated by the quench are relaxed.

Blocks are then cut to the desired size and are machined so as, in particular, to form the mold cavity for the article which it is desired to obtain by molding.

The surface of the mold cavity may then be subjected to a surface treatment such as polishing or graining, in order to give the desired surface appearance, and possibly be nitrided or chromized.

By way of example, molds have been produced with steel A of composition (% by weight):

C=0.25%
Si=0.25%
Mn=1.1%
Cr=1.3%
Mo=0.35%
Ni=0.25%
V=0.04%
Cu=0.3%
B=0.0027%
Al=0.025%
Ti=0.020%
S=0.001%
P=0.010%

400 mm thick blocks were produced, austenized at 900° C. for 1 hour, water quenched and then tempered at 550° C. for 1 hour and cooled in air. A martensito-bainitic structure is thus obtained which has a hardness of between 300 HB and 318 HB at all points in the product. The yield strength Re is 883 MPa and the tensile strength Rm is 970 MPa, i.e. an Re/Rm ratio of approximately 0.91; the impact strength KCV at +20° C. is of the order of 60 J/cm$^2$.

The carbon equivalent of this steel, calculated using the IIW formula, $$C_{eq}=C+Mn/6+(Cr+Mo+V)/5+(Ni+Cu)/15$$

is:

$$C_{eq}=0.808;$$

the BH number is:

$$BH=508;$$

the machinability index is:

$$U=151;$$

and the thermal conductivity is:

$$\lambda=41W.m^{-1}K^{-1}.$$

By way of comparison, in a block of the same size, made from a P20-type steel composition:

C=0.34%
Si=0.45%
Mn=0.95%
Cr=1.85%
Ni=0.3%
Mo=0.38% after austenization at 900° C., a water quench and a 580° C. temper for 1 hour, the hardness was comparable and centered around 300 HB. The yield strength Re was 825 MPa and the tensile strength Rm was 1010 MPa, i.e. an Re/Rm ratio of approximately 0.82. The impact strength KCV at +20° C. was of the order of 20 J/cm$^2$.

The carbon equivalent was:

$$C_{eq}=0.964;$$

the BH coefficient was:

$$BH=591;$$

the machinability index was:

$$U=207;$$

and the thermal conductivity was:

$$\lambda=35W.m^{-1}K^{-1}.$$

The difference in machinability index U results in a difference in the ability to be machined, as indicated in FIG. 1, which represents Taylor drilling lines for steel A and for the P20 steel taken by way of example. In this figure, it may be seen that, at the same cutting speed, the length which may be drilled in steel A is approximately 10 times greater than in the P20 steel or, for the same length drilled, the allowable cutting speed is 25% greater in steel A than in the P20 steel.

Since the weldability is all the better the lower the carbon equivalent or the lower the BH coefficient, it may be stated that the steel according to the invention has better weldability than the P20 steel.

It is found that steel A has a 17% higher thermal conductivity than the P20 steel and it has a yield strength and impact strength markedly superior to those for the P20 steel.

Also by way of comparison, a block of similar size was produced from a steel of composition:

C=0.17%
Si=0.09%
Mn=2.15%
Cr=1.45%
Mo=1.08%
V=0.55%
B=0.0007%

After austenization at 900° C., a water quench and a 570° C. temper, the block had a hardness of approximately 300 HB throughout its volume and:

the carbon equivalent was:

$$C_{eq}=1.144;$$

the BH coefficient was:

$$BH=435;$$

the machinability index U was:

$$U=153;$$

and the thermal conductivity was:

$$\lambda=35W.m^{31\ 1}K^{-1}.$$

This steel has a better BH number than that of steel A, but it has a worse carbon equivalent. Its machinability index is comparable to that of steel A, but its thermal conductivity is 15% lower.

400 mm thick blocks were also manufactured from steel B according to the invention, these being austenized at 920° C., quenched in water and tempered at 560° C. and then air cooled. The hardness at every point was between 300 HB and 315 HB. The yield strength Re was 878 MPa and the tensile strength Rm was 969 MPa, i.e. an Re/Rm ratio of 0.91.

The composition of the steel was:

C=0.25%
Si=0.1%
Mn=1.3%
Cr=1.3%
Mo=0.4%
V=0.01%

B=0.0025%

Al=0.055%

S=0.002%

P=0.015%

Ni=0.8%

Cu=0.35%.

The carbon equivalent was:

$$C_{eq}=0.83;$$

the BH coefficient was:

$$BH=512;$$

the machinability index was:

$$U=153;$$

and the thermal conductivity was:

$$\lambda=44 W.m^{-1}K^{-1}.$$

This steel, the composition of which is distinguished from that of steel A mainly by the silicon and nickel contents, has the same advantages as steel A and, in addition, has a much better thermal conductivity.

We claim:

1. A low alloy steel, the chemical composition of which comprises, by weight:

0.24%≦0.35%

1%≦Mn≦2.5%

0.3%≦Cr≦2.5%

0.1%≦Mo+W/2≦0.8%

0.1%≦W/2≦0.8%

Ni≦2.5%

0%≦V≦0.3%

Si≦0.5%

0.002%≦B≦0.005%

0.005%≦Al≦0.1%

0%≦Ti≦0.1%

P≦0.02%

Cu≦2% optionally at least one element taken from Nb, Zr, S, Se, Te, Bi, Ca, Sb, Pb, In and rare earths, in amounts of less than 0.1%, the balance being iron and impurities associated with smelting, the chemical composition furthermore satisfying the relationships:

$$U=409(\%\ C)+19.3[\%\ Cr+(\%\ Mo+\%\ W/2)+\%\ V]+29.4(\%\ Si)+10(\%\ Mn)+7.2(\%\ Ni)<200$$

and $$R=3.82(\%\ C)+9.79(\%\ Si)+3.34(\%\ Mn)+11.94(\%\ P)+2.39(\%\ Ni)+1.43(\%\ Cr)+1.43(\%\ Mo+\%\ W/2)<11.14$$

2. The low alloy steel as claimed in claim 1, wherein the chemical composition of the low alloy steel comprises, by weight:

0.24%≦C≦0.28%

1%≦Mn≦1.3%

1%≦Cr≦1.5%

0.3%≦Mo+W/2≦0.4%

0.03%≦V≦0.1%.

3. The low alloy steel as claimed in claim 1, wherein Si≦0.1%.

4. The low alloy steel as claimed in claim 1, wherein:

0.5%≦Ni≦2.5%

0.5%≦Cu≦2%.

5. A mold for plastics or for rubber, comprised of at least one quenched and tempered steel block formed from a low alloy steel, the chemical composition of which includes by weight:

0.24%≦C≦0.35%

1%≦Mn≦2.5%

0.3%≦Cr≦2.5%

0.1% Mo+W/2≦0.8%

Ni≦2.5%

0%≦V≦0.3%

Si≦0.5%

0.002%≦B≦0.005%

0.005%≦Al≦0.1%

0%≦Ti≦0.1%

P≦0.02%

Cu≦2% and optionally at least one element taken from Nb, Zr, S, Se, Te, Bi, Ca, Sb, Pb, In and rare earths, in amounts of less than 0.1%, the balance being iron and impurities associated with smelting, wherein the chemical composition further satisfies the following relationships:

$$U=409(\%\ C)+19.3[\%\ Cr+(\%\ MO+\%\ W/2)+\%\ V]=29.4(\%\ Si)+10(\%\ Mn)+7.2(\%\ Ni)<200$$

and $$R=3.82(\%\ C)+9.79(\%\ Si)+3.34(\%\ Mn)+11.94(\%\ P)+2.39(\%\ Ni)+1.43(\%\ Cr)+1.43(\%\ Mo+\%\ W/2)<11.14.$$

6. A mold as claimed in claim 5 for plastics or for rubber comprising at least one block of machined steel, quenched and tempered, of hardness between 270 HB and 350 HB.

7. A low alloy steel, the chemical composition of which comprises, by weight:

0.24%≦C≦0.28%

1%≦Mn≦1.3%

0.3%≦Cr≦1.5%

0.3%≦Mo+W/2≦0.4%

Ni≦2.5%

0%≦V≦0.3%

Si≦0.5%

0.002%≦B≦0.005%

0.005%≦Al≦0.1%

0%≦Ti≦0.1%

P≦0.02%

Cu≦2% optionally at least one element taken from Nb, Zr, S, Se, Te, Bi, Ca, Sb, Pb, In and rare earths, in amounts of less than 0.1%, the balance being iron and impurities associated with smelting, the chemical composition furthermore satisfying the relationships:

$$U=409(\%\ C)+19.3[\%\ Cr+(\%\ Mo+\%\ W/2)+\%\ V]+29.4(\%\ Si)+$$

$$10(\%\ Mn)+7.2(\%\ Ni)<200$$

and $$R=3.82(\%\ C)+9.79(\%\ Si)+3.34(\%\ Mn)+11.94(\%\ P)+2.39(\%\ Ni)+1.43(\%\ Cr)+1.43(\%\ Mo+\%\ W/2)<11.14$$

8. The low alloy steel as claimed in claim 7, wherein the chemical composition of the low alloy steel comprises, by weight: $Si \leqq 0.1\%$.

9. The low alloy steel as claimed in claim 7, wherein:

$0.5\% \leqq Ni \leqq 2.5\%$ $0.5\% \leqq Cu \leqq 2\%$.

10. A mold for plastics or for rubber comprising at least one machined block of steel defined in claim 7, quenched and tempered.

11. A mold as claimed in claim 10 wherein said machined one block of steel has a hardness of between 270 HB and 350 HB.

* * * * *